US007500838B2

(12) United States Patent
Ohmi

(10) Patent No.: US 7,500,838 B2
(45) Date of Patent: Mar. 10, 2009

(54) VACUUM PUMP WITH A PAIR OF SCREW ROTORS

(76) Inventor: Tadahiro Ohmi, 1-17-301, Komegafukuro 2-chome, Aoba-ku, Sendai-shi, Miyagi (JP)

( * ) Notice: Subject to any disclaimer, the term of this patent is extended or adjusted under 35 U.S.C. 154(b) by 416 days.

(21) Appl. No.: 10/547,694

(22) PCT Filed: Feb. 27, 2004

(86) PCT No.: PCT/JP2004/002360

§ 371 (c)(1),
(2), (4) Date: Sep. 2, 2006

(87) PCT Pub. No.: WO2004/079197

PCT Pub. Date: Sep. 16, 2004

(65) Prior Publication Data

US 2006/0188383 A1 Aug. 24, 2006

(30) Foreign Application Priority Data

Mar. 3, 2003 (JP) ..... 2003-055225

(51) Int. Cl.
*F01C 19/00* (2006.01)
*F03C 2/00* (2006.01)

(52) U.S. Cl. ..... 418/104; 418/178; 418/179; 418/201.1; 277/411; 277/418; 277/935; 277/936

(58) Field of Classification Search ..... 418/104, 418/201.1, 178, 179; 277/411, 412, 417, 277/418, 423, 432, 927, 935, 936, 409
See application file for complete search history.

(56) References Cited

U.S. PATENT DOCUMENTS 4,487,563 A * 12/1984 Mori et al. ..... 418/201.1
4,770,609 A * 9/1988 Uchida et al. ..... 418/9
4,781,553 A * 11/1988 Nomura et al. ..... 418/104
4,993,930 A * 2/1991 Uchida et al. ..... 418/104
5,009,583 A * 4/1991 Carlsson et al. ..... 418/104

(Continued)

FOREIGN PATENT DOCUMENTS

JP 62-184191 11/1987

(Continued)

OTHER PUBLICATIONS

Physics Dictionary, Physics Dictionary Editorial Board, Baifukan, Revised Edition, published May 20, 1992, p. 1019.

*Primary Examiner*—Theresa Trieu
(74) *Attorney, Agent, or Firm*—Foley & Lardner LLP

(57) ABSTRACT

A vacuum pump, comprising a pair of screw rotors having a first screw rotor with a plurality of spiral land parts and a second screw rotor with a plurality of spiral groove parts and rotating about two axes substantially parallel with each other while engagement with each other, a casing storing the pair of screw rotors, and a pair of bearings installed on a pair of shafts (4) supporting the pair of screw rotors. The vacuum pump is characterized in that a pair of shaft seals (5) in non-contact with the pair of shafts (4) are installed between the pair of screw rotors and the pair of bearings, and each of the pair of shaft seals (5) is of a static pressure type and leads seal gas through a shaft seal portion.

6 Claims, 5 Drawing Sheets

U.S. PATENT DOCUMENTS 6,283,739 B1 * 9/2001 Berezin et al. ..... 418/104

FOREIGN PATENT DOCUMENTS

JP 63-285279 11/1988
JP 11-270482 10/1999
JP 2000-213488 A 8/2000
JP 2001-056027 2/2001

* cited by examiner

VACUUM PUMP WITH A PAIR OF SCREW ROTORS

TECHNICAL FIELD

This invention relates to a vacuum pump and, in particular, relates to a vacuum pump suitable for semiconductor manufacturing.

BACKGROUND ART

In the field of manufacturing semiconductor wafers, vacuum pumps have conventionally been used. Use is made of, for example, a screw pump as the vacuum pump. The screw pump is disclosed, for example, in the following non-patent literature 1 as a screw type pump.

Non-Patent Literature 1: "Physics Dictionary" compiled by Physics Dictionary Editorial Board, Baifukan, Revised Edition published May 20, 1992, p. 1019

Generally, the screw pump comprises a pair of screw rotors having a first screw rotor with a plurality of helical land portions (a male rotor with convex thread ridges) and a second screw rotor with a plurality of helical groove portions (a female rotor with concave thread grooves) and adapted to rotate about two axes substantially parallel to each other while engagement with each other, and a casing receiving therein the pair of screw rotors and having an inlet port and a discharge port. Herein, since the first screw rotor (the male rotor with the convex thread ridges) has not only the plurality of helical land portions but also a plurality of helical groove portions, it can also be said that the first screw rotor has the plurality of helical land portions and the plurality of helical groove portions. Likewise, since the second screw rotor (the female rotor with the concave thread grooves) has not only the plurality of helical groove portions but also a plurality of helical land portions, it can also be said that the second screw rotor also has the plurality of helical land portions and the plurality of helical groove portions. Further, a pair of shafts supporting the pair of screw rotors are provided with a pair of bearings and a pair of shaft seal members.

In the conventional screw pump, ball bearings are generally used as the bearings. Therefore, seal mechanisms such as oil seals or mechanical seals are added between the screws and the ball bearings. However, since it is not possible to completely prevent leakage of ball bearing oil to the screw side and further since a large amount of gas is introduced to the seal portions, there has been a technical problem that, in case of being used as a vacuum pump in a processing step (plasma etching, reduced-pressure vapor phase epitaxy) that emits a toxic gas, a corrosive gas, or the like in a pressure-reduced state when, for example, manufacturing semiconductor devices, the gas contacts the ball bearings so that the bearings are corroded and reaction product is accumulated on the ball bearings to impede smooth operation.

Further, there has been a technical problem that since the gas introducing amount is large, a huge cost is required for separating and recovering an expensive gas such as Kr or Xe used in the processing step.

DISCLOSURE OF THE INVENTION

This invention has been made for solving the foregoing problems and has an object to provide a vacuum pump having shaft seals that prevent corrosion due to corrosive gas and further ensure smooth operation.

Vacuum pumps according to this invention are as follows.

(1) A vacuum pump comprising a pair of screw rotors having a first screw rotor with a plurality of helical land portions and a second screw rotor with a plurality of helical groove portions and adapted to rotate about two axes substantially parallel to each other while engagement with each other, a casing receiving therein the pair of screw rotors, and a pair of bearings provided on a pair of shafts supporting the pair of screw rotors, the vacuum pump characterized in that a pair of shaft seals are provided between the pair of screw rotors and the pair of bearings so as not to be in contact with the pair of shafts during steadiness operation, the pair of shaft seals are each a static pressure shaft seal, and a seal gas is introduced between the shaft seals and the shafts through portions of the shaft seals.

(2) A vacuum pump according to the vacuum pump as recited in the foregoing item (1), characterized in that the pair of shaft seals each comprise a porous member.

(3) A vacuum pump according to the vacuum pump as recited in the foregoing item (2), characterized in that a porosity of the porous member is 1% to 20% and a flexural strength of the porous member is 20 MPa to 100 MPa.

(4) A vacuum pump according to the vacuum pump as recited in any of the foregoing items (1) to (3), characterized in that the pair of shaft seals comprise a pair of shaft seal members provided between the pair of screw rotors and the pair of bearings so as not to be in contact with the pair of shafts during the steadiness operation, a tapered surface is formed inside each of the pair of shaft seal members so as to taper off as going away from the corresponding screw rotor, and bearing housings are formed each on a bearing side with respect to the corresponding shaft seal member.

(5) A vacuum pump comprising a pair of screw rotors having a first screw rotor with a plurality of helical land portions and a second screw rotor with a plurality of helical groove portions and adapted to rotate about two axes substantially parallel to each other while engagement with each other, a casing receiving therein the pair of screw rotors, and a pair of bearings provided on a pair of shafts supporting the pair of screw rotors, the vacuum pump characterized in that:

a pair of shaft seals are provided between the pair of screw rotors and the pair of bearings so as not to be in contact with the pair of shafts during steadiness operation of the screw rotors, the pair of shaft seals are each a static pressure shaft seal, a seal gas is introduced between the pair of shaft seals and the pair of shafts, respectively, and the pair of shaft seals themselves are centered with respect to the pair of shafts, respectively, due to the introduced gas.

(6) A vacuum pump according to the vacuum pump as recited in the foregoing item (5), characterized in that a tapered surface is formed inside each of shaft seal members of the pair of shaft seals so as to taper off as going away from the corresponding screw rotor and bearing housings are formed each on a bearing side with respect to the corresponding shaft seal member.

(7) A vacuum pump according to the vacuum pump as recited in the foregoing item (5) or (6), characterized in that the pair of shaft seals each comprise a porous portion as a shaft seal member.

(8) A vacuum pump according to the vacuum pump as recited in the foregoing item (7), characterized in that the shaft seal members themselves of the pair of shaft seals are centered with respect to the pair of shafts, respectively, by the use of the gas having passed through the porous portions of the shaft seal members of the pair of shaft seals to enter between the pair of shaft seals and the pair of shafts, respectively.

According to this invention, it is possible to obtain a vacuum pump comprising shaft seals that largely reduce the consumption amount of seal gas, prevent corrosion due to corrosive gas, facilitate gas recovery, and further ensure smooth operation.

BEST MODE FOR CARRYING OUT THE INVENTION

Now, a vacuum pump according to this invention will be described on the basis of an embodiment shown in the figures. This embodiment will be described using a screw pump of FIG. 1 as an example.

Figure 1:
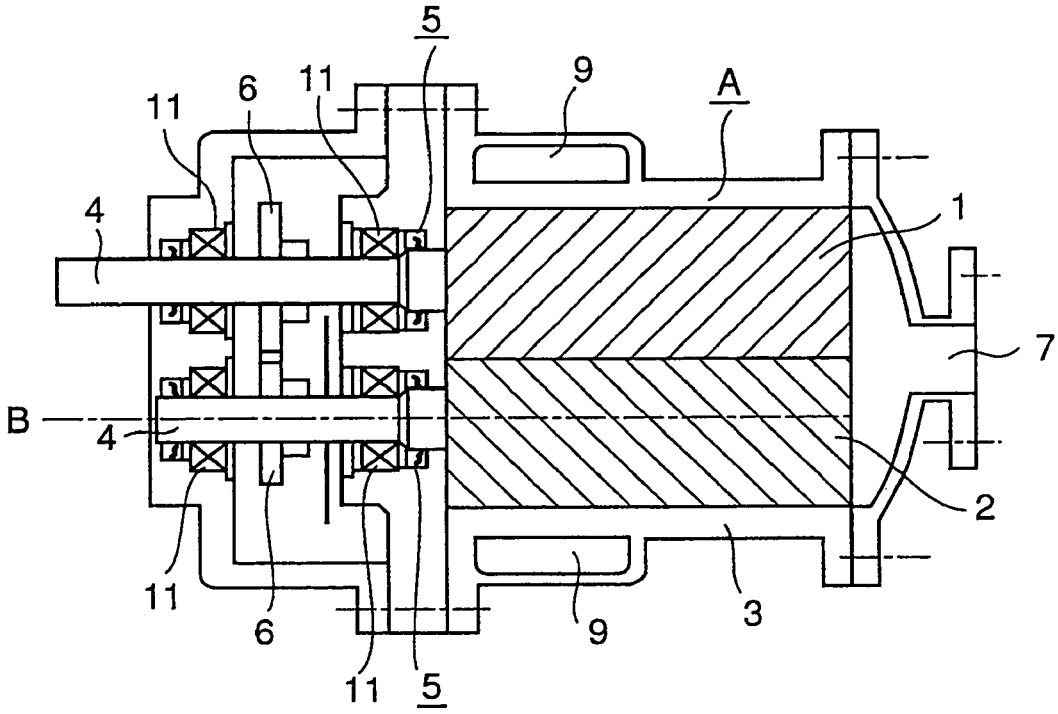
FIG. 1 is a section view of a screw pump according to an embodiment of this invention.

In FIG. 1, a screw pump body A comprises a pair of screw rotors 1 and 2.

Figure 2:
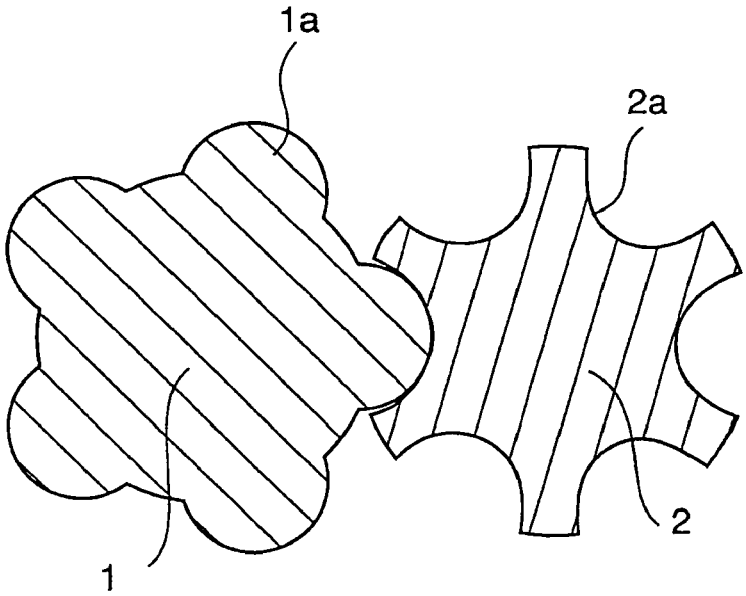
FIG. 2 is a cross section view of a pair of screw rotors of the screw pump shown in FIG. 1.

Referring to FIG. 2, the screw rotor 1 is a first screw rotor (male rotor) having a plurality of helical land portions (convex thread ridges) l*a* and the screw rotor 2 is a second screw rotor (female rotor) having a plurality of helical groove portions (concave thread grooves) 2*a*. These screw rotors 1 and 2 rotate about two axes substantially parallel to each other while engagement with each other.

Referring back to FIG. 1, the screw rotors 1 and 2 are received in a casing 3 and rotatably supported by a pair of bearings 11 at one-end portions of a pair of shafts 4 supporting the screw rotors 1 and 2. Timing gears 6 are attached to the shafts 4 at the one-end portions thereof so that the pair of screw rotors 1 and 2 are synchronously rotated through the timing gears 6.

Figure 3:
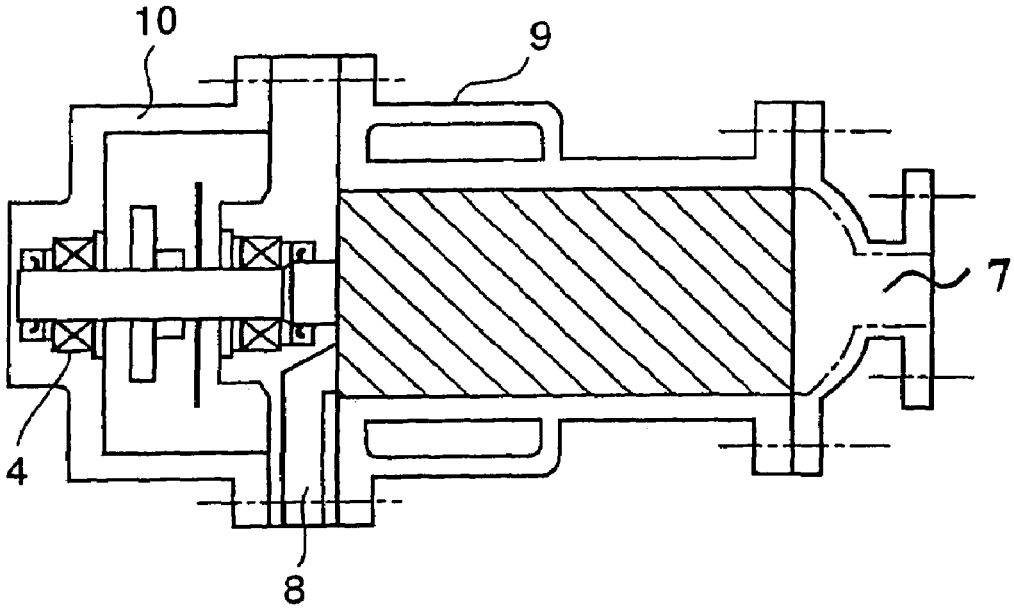
FIG. 3 is a section view taken along line B in FIG. 1.

Referring also to FIG. 3 in addition to FIG. 1, an inlet port 7 is formed on the opposite-end side of the casing 3 receiving therein the pair of screw rotors 1 and 2 while a discharge port 8 (FIG. 3) is formed on the one-end side of the casing 3. When the screw rotors 1 and 2 synchronously rotate, a gas is sucked through the inlet port 7 and exhausted through the discharge port 8 so that the operation of the vacuum pump is carried out.

Further, on the discharge port 8 side of the casing 3, there is formed a jacket 9 having a cavity portion and capable of circulating cooling water therethrough so that it is possible to particularly cool heat of a gas caused by the compression operation on the discharge port 8 side.

At the one-end portion of the casing 3 having the screw rotors 1 and 2 received therein, a cover 10 is attached and the shaft 4 supporting the screw rotor 1 projects from the cover 10 so as to be directly connected to a rotation shaft of a later-described motor. Further, shaft seals 5 are provided between the screw rotor 1 and the bearing 11 and between the screw rotor 2 and the bearing 11, respectively.

Figure 4:
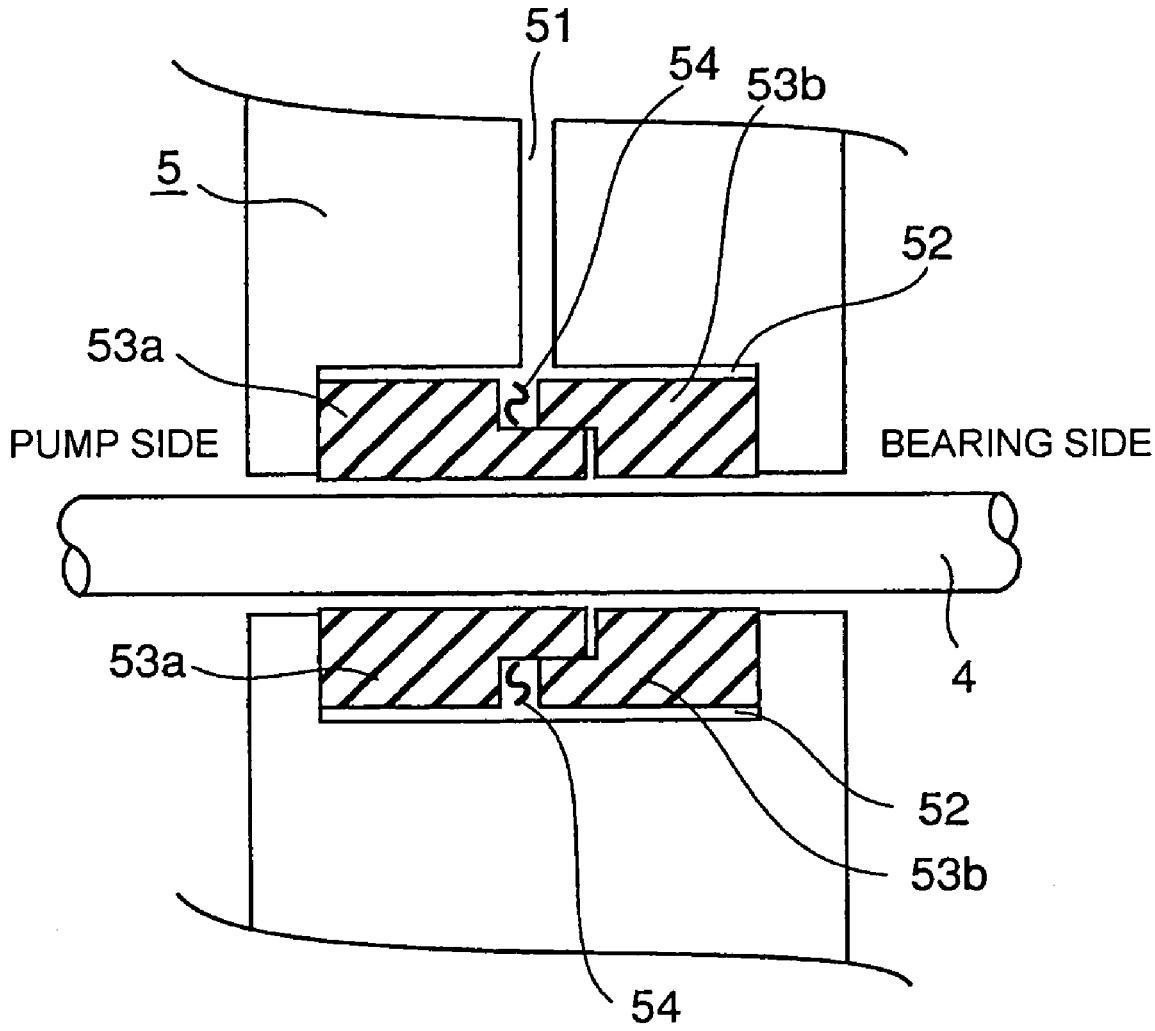
FIG. 4 is a section view showing a shaft seal of the screw pump shown in FIG. 1.

Now, referring to FIG. 4, description will be given in detail of a structure of the shaft seal 5 with a centering mechanism. In FIG. 4, the shaft seal 5 is illustrated in a manner where left and right are reversed as compared with that in FIGS. 1 and 3. The shaft seal 5 is a static pressure shaft seal and an inert gas such as, for example, a nitrogen gas is introduced into the shaft seal inside 52 through a through hole 51 under a predetermined pressure. In the shaft seal inside 52, there are disposed two shaft seal members 53*a* and 53*b* each in the form of a porous member made of carbon or the like. These two shaft seal members 53*a* and 53*b* are combined together. In order to dispose the two shaft seal members 53*a* and 53*b* with no clearances in the shaft seal inside 52, a plate spring 54 is provided for urging the two shaft seal members 53*a* and 53*b* in extending directions of the shaft 4.

It is preferable that the porosity of the porous members, i.e. the shaft seal members 53*a* and 53*b*, be set to 1% to 20% and the mechanical strength (flexural strength) thereof be set to 20 MPa to 100 MPa. Further, the pressure of the inert gas such as the nitrogen gas introduced into the shaft seal inside 52 is preferably set to 0.01 MPa to 0.5 MPa.

The shaft seal members 53*a* and 53*b* are formed by the porous members as described above and, further, the high-pressure inert gas passes between the shaft 4 and the shaft seal members 53*a* and 53*b* and flows to the bearing side while a portion thereof also flows to the screw rotor side (pump side) being the pressure reducing side.

As a result, a corrosive gas or the like does not contact the bearing 11 (FIG. 1), thereby preventing troubles like corrosion of the bearing 11 and accumulation of reaction product on the bearing to impede smooth operation. Further, since the shaft seal members 53*a* and 53*b* are centered with respect to the shaft 4 by the flow of the seal gas, clearances between the shaft 4 and the shaft seal members 53*a* and 53*b* can be narrowed. Consequently, the consumption amount of the seal gas can be reduced.

It is possible that the shaft seal members contact the shaft at the start of the operation or before the seal gas flows. However, at least during the steadiness operation, the shaft seal members are not in contact with the shaft.

Modifications will be described with reference to FIGS. 5 and 6.

Figure 5:
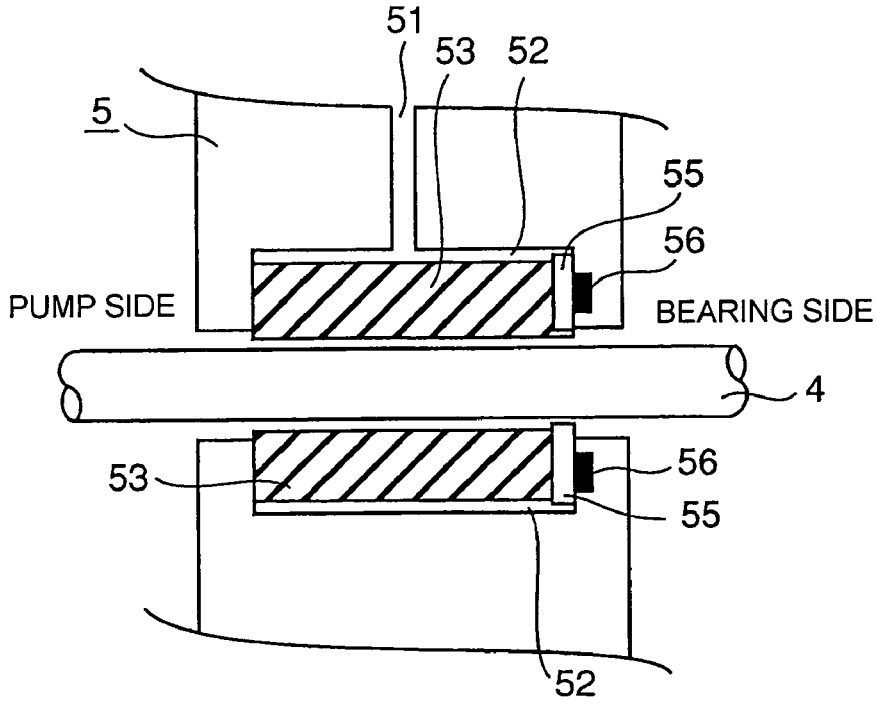
FIG. 5 is a section view of a modification of a shaft seal that can be used in a screw pump of this invention.

In FIG. 5, a shaft seal member 53 is formed as an integral shaft seal member, gas leakage from a side is prevented by the use of an O-ring 56 through a spacer 55 and, since the shaft seal member 53 is centered with respect to the shaft 4 by the seal gas having passed through the shaft seal member 53, clearances between the shaft 4 and the shaft seal member 53 can be narrowed.

Figure 6:
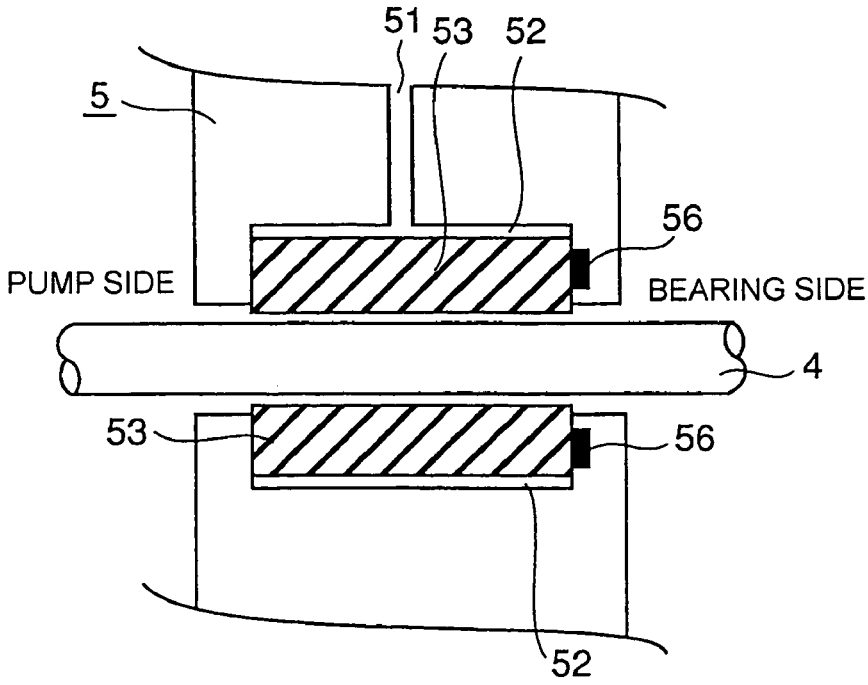
FIG. 6 is a section view showing another modification of a shaft seal that can be used in a screw pump of this invention.

With respect to FIG. 6, the same effect can be maintained without the spacer 55 in FIG. 5 by the use of an O-ring 56 having excellent smoothness.

Figure 7:
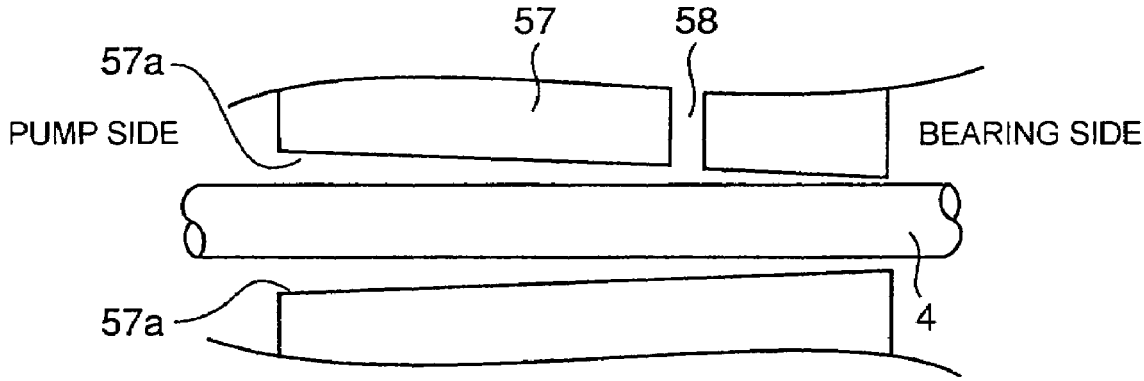
FIG. 7 is a section view showing still another modification of a shaft seal that can be used in a screw pump of this invention.

Now, referring to FIG. 7, a structure of a shaft seal member 57 will be described in detail. This shaft seal member 57 is not necessarily a porous member. However, when it is not the porous member, it is necessary to provide a seal gas inlet 58.

Inside the shaft seal member 57, there is formed a so-called tapered surface 57*a* that tapers off as going away from the screw rotor (pump). The seal gas inlet 58 is provided at a position of a ratio where back diffusion does not occur either to the screw rotor side (pump side) or to the bearing side. Although not illustrated in the figure, a housing of the bearing is provided on the bearing side with respect to the shaft seal member 57.

Since, as described above, the tapered surface 57*a* is formed inside the shaft seal member 57, even when the shaft 4 is subjected to vibration due to the bearing, there is no occurrence of contact between the shaft 4 and the shaft seal member 57 so that it is possible to maintain the seal function and achieve smooth rotation.

As described above, according to this invention, it is possible to obtain the vacuum pump comprising the shaft seals that largely reduce the consumption amount of the seal gas, prevent corrosion due to the corrosive gas, facilitate the gas recovery, and further ensure the smooth operation.

The invention claimed is:

1. A vacuum pump comprising a pair of screw rotors having a first screw rotor with a plurality of helical land portions and a second screw rotor with a plurality of helical groove portions and adapted to rotate about two axes substantially parallel to each other while engagement with each other, a casing receiving therein said pair of screw rotors, and a pair of bearings provided on a pair of shafts supporting said pair of screw rotors, said vacuum pump characterized in that a pair of shaft seals are provided between said pair of screw rotors and said pair of bearings so as not to be in contact with said pair of shafts during steadiness operation, said pair of shaft seals are each a static pressure shaft seal, and a seal gas is introduced between said shaft seals and said shafts through portions of said shaft seals, and that said pair of shaft seals comprise a pair of shaft seal members provided between said pair of screw rotors and said pair of bearings so as not to be in contact with said pair of shafts during the steadiness operation, a tapered surface is formed inside each of said pair of shaft seal members so as to taper off as going away from the corresponding screw rotor, and bearing housings are formed each on a bearing side with respect to the corresponding shaft seal member.

2. A vacuum pump according to claim 1, characterized in that said pair of shaft seals each comprise a porous member.

3. A vacuum pump according to claim 2, characterized in that a porosity of said porous member is 1% to 20% and a flexural strength of said porous member is 20 MPa to 100 MPa.

4. A vacuum pump comprising a pair of screw rotors having a first screw rotor with a plurality of helical land portions and a second screw rotor with a plurality of helical groove portions and adapted to rotate about two axes substantially parallel to each other while engagement with each other, a casing receiving therein said pair of screw rotors, and a pair of bearings provided on a pair of shafts supporting said pair of screw rotors, said vacuum pump characterized in that a pair of shaft seals are provided between said pair of screw rotors and said pair of bearings so as not to be in contact with said pair of shafts during steadiness operation of said screw rotors, said pair of shaft seals are each a static pressure shaft seal, a seal gas is introduced between said pair of shaft seals and said pair of shafts, respectively, and said pair of shaft seals themselves are centered with respect to said pair of shafts, respectively, due to the introduced gas, and that a tapered surface is formed inside each of shaft seal members of said pair of shaft seals so as to taper off as going away from the corresponding screw rotor and bearing housings are formed each on a bearing side with respect to the corresponding shaft seal member.

5. A vacuum pump according to claim 4, characterized in that said pair of shaft seals each comprise a porous portion as a shaft seal member.

6. A vacuum pump according to claim 5, characterized in that said shaft seal members themselves of said pair of shaft seals are centered with respect to said pair of shafts, respectively, by the use of the gas having passed through the porous portions of the shaft seal members of said pair of shaft seals to enter between said pair of shaft seals and said pair of shafts, respectively.

* * * * *